US007684743B2

(12) United States Patent
Iwahashi et al.

(10) Patent No.: US 7,684,743 B2
(45) Date of Patent: Mar. 23, 2010

(54) FIXING DEVICE

(75) Inventors: Haruo Iwahashi, Hoi-gun (JP); Yasuhiro Ohno, Toyokawa (JP); Yuji Kamoda, Ibaraki (JP); Tomohiko Masuda, Otsu (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 218 days.

(21) Appl. No.: 11/521,565

(22) Filed: Sep. 15, 2006

(65) Prior Publication Data

US 2007/0122213 A1 May 31, 2007

(30) Foreign Application Priority Data

Nov. 25, 2005 (JP) ..... 2005-340195

(51) Int. Cl.
*G03G 15/20* (2006.01)

(52) U.S. Cl. ..... 399/320; 399/33; 399/67; 399/122; 399/328; 219/216

(58) Field of Classification Search ..... 399/33, 399/67, 122, 320, 328; 219/216
See application file for complete search history.

(56) References Cited

U.S. PATENT DOCUMENTS 6,810,230 B2 * 10/2004 Imai et al. ..... 399/328
6,882,807 B2 * 4/2005 Sakagami ..... 399/69
6,900,419 B2 * 5/2005 Takagi et al. ..... 219/619
6,936,800 B2 * 8/2005 Kinouchi et al. ..... 219/663
2006/0072931 A1 4/2006 Asakura et al.

FOREIGN PATENT DOCUMENTS

JP 2000-214702 A 8/2000
JP 2000-214713 A 8/2000
WO WO 2004/074944 9/2004

OTHER PUBLICATIONS

Analysis of Series Resonant Superimposed Inverter Applied to Induction Heating, By P.K. Sadhu et al. IE(I) Journal-EL, vol. 84, Mar. 2004.*
Preliminary Notice of Rejection in JP 2005-340195 dated May 27, 2008, and English Translation thereof.

* cited by examiner

*Primary Examiner*—David M Gray
*Assistant Examiner*—G. M. Hyder
(74) *Attorney, Agent, or Firm*—Buchanan Ingersoll & Rooney PC

(57) ABSTRACT

A fixing device includes a magnetic flux generating section having a coil which generates a magnetic flux when applying current, a fixing roller having a heat generating layer having a thickness of 100 μm or less formed along an outer peripheral surface of the fixing roller for generating heat through electromagnetic induction by the magnetic flux, a capacitor connected in series to the coil to constitute a series resonant circuit, and high frequency power supply circuits for applying voltage having a certain drive frequency to the series resonant circuit so as to make the fixing roller generate heat through the magnetic flux generating section. An image is fixed onto a sheet, which is transported in a state of being in pressure-contact with the outer peripheral surface of the fixing roller, by heat from the heat generating layer of the fixing roller.

12 Claims, 9 Drawing Sheets

| SYMBOL | MATERIAL | OUTER DIAMETER | HOLLOW/ SOLID |
|---|---|---|---|
| —▽— | A1 | A | HOLLOW(4t) |
| —⊙— | A1 | A | SOLID |
| —◇— | A1 | B | SOLID |
| —□— | A1 | C | SOLID |
| —△— | SUS304 | C | SOLID |
| —○— | Fe | C | SOLID |

FIXING DEVICE

CROSS-REFERENCE TO RELATED APPLICATIONS

This application is based on application No. 2005-340195 filed in Japan, the entire content of which is hereby incorporated by reference.

BACKGROUND OF THE INVENTION

The present invention relates to a fixing device, and more particularly relates to a fixing device for fixing images on a sheet with use of heat from a fixing roller heated by the electromagnetic induction heating method.

A fixing device of this kind has been known as described in JP 2000-214702 A or JP 2000-214713 A. The fixing device has a fixing roller and a pressure roller in pressure-contact with each other, wherein an electromagnetic induction heat generating layer (hereinbelow referred to as "heat generating layer") of the fixing roller is heated by a magnetic flux generated in a magnetic flux generating section. Then, a recording member carrying an unfixed image is held and transported by a nip section, which is made up of a pressure-contacted portion of the rollers, so as to melt and fix the unfixed image on the recording member. To enhance a temperature rise characteristic by reducing thermal capacity, a thin nickel-electroformed endless belt layer of e.g. 100 μm in thickness is used for the heat generating layer of the fixing roller.

As shown in an equivalent circuit of FIG. 12, an electric power to the magnetic flux generating section is conventionally supplied by a high frequency (HF) inverter 104 including a parallel resonant circuit 142. The HF inverter 104 includes an AC power source 140, a rectification circuit 141 made up of a diode bridge DB141, a smoothing coil Lf141 and a smoothing capacitor Cf141, a switching element 145 made from a power transistor, a flywheel diode D145 for protecting the switching element 145 from overvoltage, and the parallel resonant circuit 142 including a resonant capacitor 144. The resonant capacitor 144 is connected in parallel to a coil 143 (placed along the fixing roller) included in the magnetic flux generating section. An inductance and an effective resistance (including contribution from the fixing roller coupled with the coil by electromagnetic induction) observed on both ends of the coil 143 are respectively referred to as Ls143 and Rs143.

In the case where the heat generating layer (nickel layer) of the fixing roller has a thickness as thin as 100 μm or less, high heat generation efficiency can be attained by driving the fixing roller at higher frequencies to decrease a depth (unit: m) of penetration as shown by Equation (1).

$$\text{Depth of penetration}=1/(\Pi f\mu\rho)^{1/2} \quad (1)$$

where f represents a drive frequency (unit: Hz), μrepresents magnetic permeability of the heat generating layer (unit: H/m) and ρ represents conductivity of the heat generating layer (unit: S/m).

In the case where the heat generating layer (nickel layer) has a thickness of 40 μm for example, the drive frequency f is required to be at least about 40 kHz and ideally be 60 kHz or more.

As is clear from drive waveforms in FIG. 13, input power (which depends on a current $I_{Ls}$ flowing through the coil 143) is dependent on a length of a turn-on period T (which is a period when a collector-emitter voltage $V_{CE}$ is low) of the switching element in the HF inverter 104. If the drive frequency f is made higher, then the turn-on period T of the switching element is shortened, which makes it difficult to secure high input power. For example, for securing power of about 1200 W, an upper limit of the drive frequency f is about 25 kHz~30 kHz.

SUMMARY OF THE INVENTION

An object of the present invention is to provide a fixing device allowing high electric power to be inputted to a fixing roller through a magnetic flux generating section when a drive frequency is high.

In order to achieve the above-mentioned object, a first aspect of the present invention provides a fixing device comprising: a magnetic flux generating section having a coil for generating a magnetic flux when applying current; a fixing roller having a heat generating layer having a thickness of 100 μm or less formed along an outer peripheral surface of the fixing roller for generating heat through electromagnetic induction by the magnetic flux; a capacitor connected in series to the coil to constitute a series resonant circuit; and a high frequency power supply circuit for applying voltage having a certain drive frequency to the series resonant circuit so as to make the fixing roller generate heat through the magnetic flux generating section, wherein an image is fixed onto a sheet of paper, which is transported in a state of being in pressure-contact with the outer peripheral surface of the fixing roller, by heat from the heat generating layer of the fixing roller.

A second aspect of the present invention provides a fixing device for fixing toner on a sheet, comprising: a fixing roller having a heat insulating layer, a heat generating layer, an elastic layer and a release layer formed in sequence around a support layer, the heating layer having a thickness of 100 μm or less; a pressure roller placed in pressure-contact with the fixing roller; a magnetic flux generating section having a coil placed in such a way as to face an outer periphery of the fixing roller and generating a magnetic flux when applying current; a capacitor connected in series to the coil to constitute a series resonant circuit; and a high frequency power supply circuit for applying voltage having a certain drive frequency to the series resonant circuit so as to make the fixing roller generate heat through the magnetic flux generating section.

In the fixing device of the present invention, the high frequency power supply circuit applies voltage having a certain drive frequency to the series resonant circuit, which makes the fixing roller generate heat through the magnetic flux generating section. In the series resonant circuit, which is composed of the coil and the capacitor, an impedance Z is minimized when the drive frequency and a resonance frequency are equal to each other. Thereby, a current flow is maximized, which maximizes electric power inputted into the fixing roller through the magnetic flux generating section (this is called "maximum input power"). Therefore, high electric power can be inputted even when the heat generating layer of the fixing roller has a thickness as thin as 100 μm or less and when the drive frequency is thereby set high. Thus, it is possible to achieve high heat generation efficiency and high input power at the same time. As a result, the device is warmed up in a short period of time, and a paper passing speed is increased.

The pressure roller is preferably provided with a nip section brought into pressure-contact with the outer peripheral surface of the fixing roller. In this case, sheets can smoothly be transported through the nip section, and therefore, the quality of fixed images can be enhanced.

Also, the high frequency power supply circuit preferably includes a pair of switching elements and a control section, where the switching elements are connected to opposite terminals of the coil and the capacitor which are connected in series to each other, and where the control section controllably switches on and off the switching elements with the drive frequency.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

The present invention will be described hereinbelow in conjunction with the embodiments with reference to the drawings.

Figure 1:
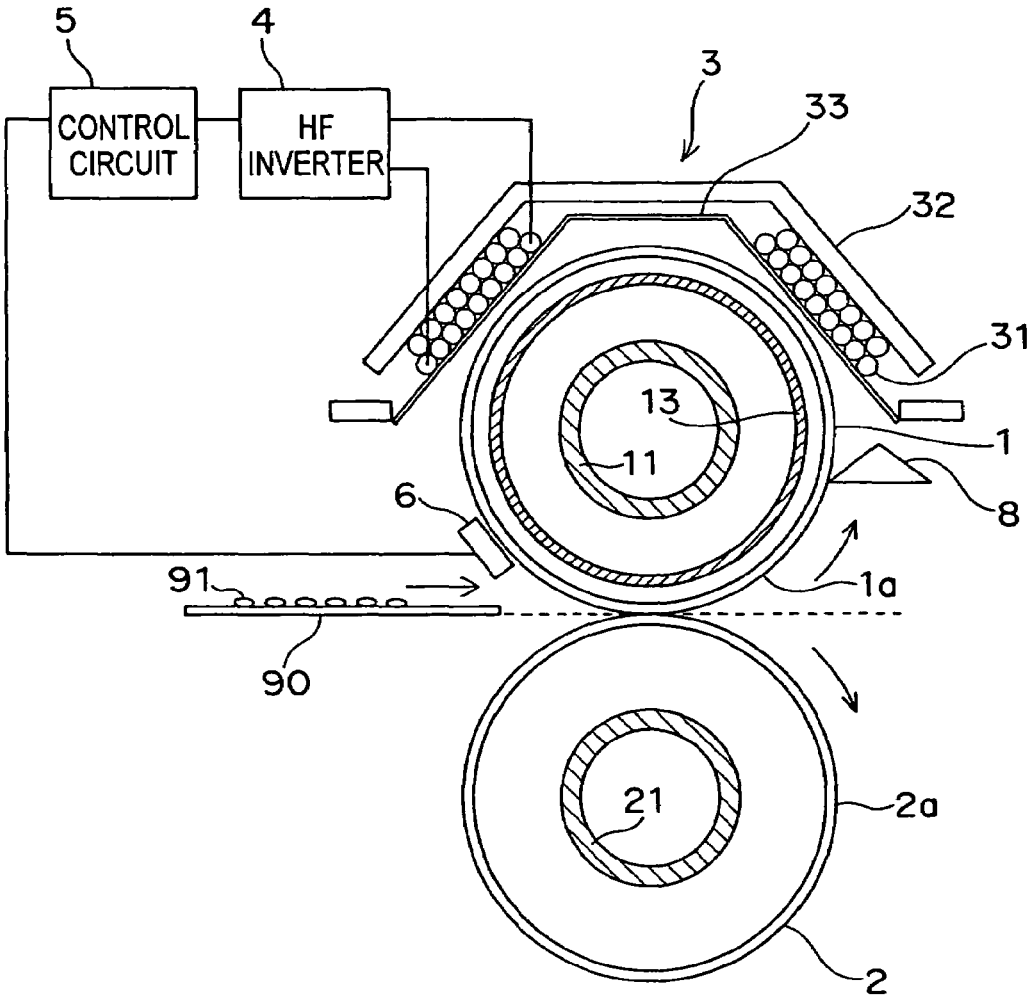
FIG. 1 is a view showing an outlined structure of a fixing device in one embodiment of the present invention.

FIG. 1 shows a cross sectional structure of a fixing device in one embodiment for laser color printers.

The fixing device mainly includes a fixing roller 1, a pressure roller 2, a magnetic flux generating section 3, a high frequency (HF) inverter 4 as a high frequency power supply circuit, and a control circuit 5. Reference numeral 6 denotes a temperature sensor, reference numeral 8 denotes a separation nail, and reference numeral 90 denotes a paper sheet as a sheet.

The fixing roller 1 and the pressure roller 2, which are cylindrical members vertically extending with respect to a sheet showing FIG. 1, are disposed vertically parallel to each other. Both ends of each of the rollers are rotatably supported by an unshown bearing member. The pressure roller 2 is biased toward the fixing roller 1 by an unshown pressing mechanism with use of a spring or the like. Consequently, a lower portion of the fixing roller 1 and an upper portion of the pressure roller 2 are brought into pressure-contact with a specified pressing force (described later) so as to form a nip section. The pressure roller 2 is rotationally driven clockwise, as shown by an arrow in the drawing, at a specified peripheral velocity by an unshown drive mechanism. The fixing roller 1 is rotated by following after rotation of the pressure roller 2 with a friction force which is attained by friction between the fixing roller 1 and the pressure roller 2 at the nip section. Otherwise, the pressure roller 2 may be rotated by following after the driven rotation of the fixing roller 1.

Figure 2:
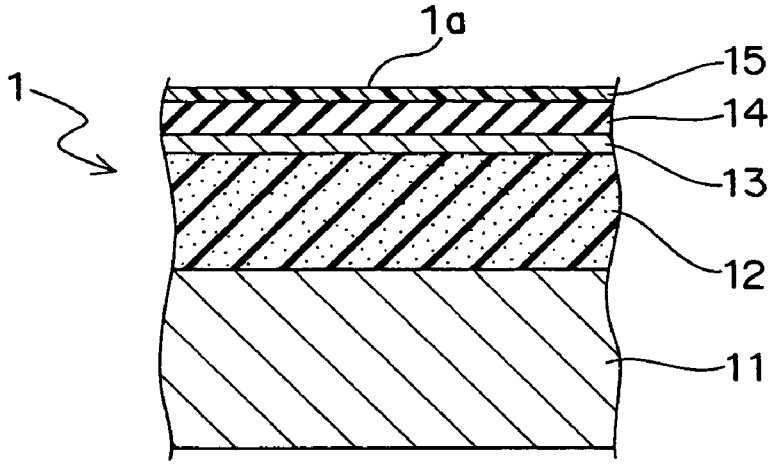
FIG. 2 is a view showing a cross sectional structure of a fixing roller in the fixing device.

As shown in FIG. 2, the fixing roller 1 has a five-layer structure composed of a core shaft 11 as a support layer, a heat insulating layer 12, a heat generating layer 13, an elastic layer 14 and a release layer 15, which are placed in sequence from a center side of the fixing roller 1 toward an outer peripheral surface 1*a*. Hardness of the fixing roller 1 is, for example, 30 to 90 degrees in Asker-C scale.

The core shaft 11 as a support layer in this embodiment is made of aluminum and has an outer diameter of 26 mm and a thickness of 4 mm. The core shaft 11 may be a molded pipe made of heat-resistant material such as steel or PPS (polyphenylene sulfide) as long as a material strength can be sufficiently ensured. However, in order to prevent the core shaft 11 from generating heat, it is preferable to use nonmagnetic materials which are not affected by electromagnetic induction.

The heat insulating layer 12 is provided mainly for putting the generating layer 13 in a heat insulated state. Rubber or resin sponge (heat insulating structure) having heat resistance and elasticity is used for material of the heat insulating layer 12. Accordingly, the heat insulating layer 12 plays not only a heat insulating role, but also a role to increase a nip width by bending the heat generating layer 13 and a role to enhance sheet discharge performance and sheet separating performance by decreasing the hardness of the fixing roller 1. In the case where the heat insulating layer 12 is made of a silicon sponge material for example, thickness thereof is set at 2 mm to 10 mm, preferably 3 mm to 7 mm, and hardness thereof is set at 20 to 60 degrees, preferably 30 to 50 degrees in measurement by an Asker rubber hardness meter. The heat insulating layer 12 may have a two-layer structure composed of a rubber and a sponge.

The heat generating layer 13 is provided to generate heat by using electromagnetic induction which is caused by a magnetic flux from the magnetic flux generating section 3. In this embodiment, the heat generating layer 13 is formed from an electroformed nickel endless belt layer having a thickness of 40 μm. The thickness of the heat generating layer 13 should be preferably 10 μm to 100 μm and more preferably 20 μm to 50 μm. The reason why the thickness of the heat generating layer 13 should be preferably 100 μm or less and more preferably 50 μm or less is to decrease the thermal capacity of the heat generating layer 13, and therefore to increase its temperature rise rate. Magnetic material such as magnetic stainless steel (magnetic metal), which has a relatively high magnetic permeability μ and an appropriate resistivity ρ, is used for material of the heat generating layer 13. Also, electrically conductive material such as metal, even if it is nonmagnetic, may be used as material for the heat generating layer 13 when it is made into a thin film. Further, the heat generating layer 13 may have such a structure that particles are dispersed in resin where the particles generate heat by electromagnetic induction. This structure makes it possible to enhance the sheet separating performance.

The elastic layer 14 is provided to enhance contact (which is important in treating color images) between a paper sheet and the surface of the fixing roller by elasticity of the elastic layer 14 in the thickness direction In this embodiment, the elastic layer 14 is made of a rubber or a resin having heat resistance and elasticity. Specifically, the elastic layer 14 is made of a heat-resistant elastomer such as silicon rubber and fluorocarbon rubber which can withstand use at fixing temperatures. It is possible to mix various fillers into the elastic layer 14 for the purpose of enhancing thermal conductivity, reinforcement or the like. Thermally conductive particles used for filler are particles of diamond, silver, copper, aluminum, marble and glass. Particles of silica, alumina, magnesium oxide, boron nitride and beryllium oxide are used for practical examples.

Thickness of the elastic layer 14 should be preferably 10 μm to 800 μm for example, and more preferably 100 μm to 300 μm. If the thickness of the elastic layer 14 is less than 10 μm, it is difficult to attain targeted elasticity in the thickness direction. If the thickness exceeds 800 μm, heat generated in the heat generating layer cannot easily reach the outer peripheral surface of a fixing film, which causes a tendency for the thermal efficiency to deteriorate.

In the case where the elastic layer 14 is made of silicon rubber, the hardness thereof should be 1 to 80 degrees and preferably 5 to 30 degrees in JIS hardness scale. This JIS hardness range makes it possible to prevent failure in fixation of toner while preventing decrease in strength of the elastic layer and failure in contact. Specifically, the silicon rubbers include one-component, two-component or three or more-component silicon rubbers, LTV (Low Temperature Vulcanization)-type, RTV (Room Temperature Vulcanization)-type or HTV (High Temperature Vulcanization)-type silicon rubbers, and condensation-type or addition-type silicon rubbers. In this embodiment, a silicon rubber with a JIS hardness of 10 degree and a thickness of 200 μm is used as the material of the elastic layer 14.

The outermost release layer 15 is provided to enhance the releasing property of the outer peripheral surface 1*a*. Material of the release layer 15 is required not only to have the releasing property for toner but also to withstand use at fixing temperatures. The release layer 15 is preferably made of silicon rubber, fluorocarbon rubber or fluorocarbon resin such as PFA (Tetrafluoroethylene perfluoroalkoxy-vinylether copolymer), PTFE (Polytetra fluoroethylene), FEP (Tetrafluoroethylene hexa-fluoro-propylene copolymer) and PFEP (Perfluoroethylene hexa-fluoro-propylene copolymer). Thickness of the release layer 15 is preferably 5 μm to 100 μm and more preferably 10 μm to 50 μm. To enhance force of interlayer adhesion, interlayer adhesion processing may be performed by using primer or the like. Conductive material, abrasion-resistant material and/or good thermal conductive material may be added to the release layer 15 as filler, when needed.

Figure 3:
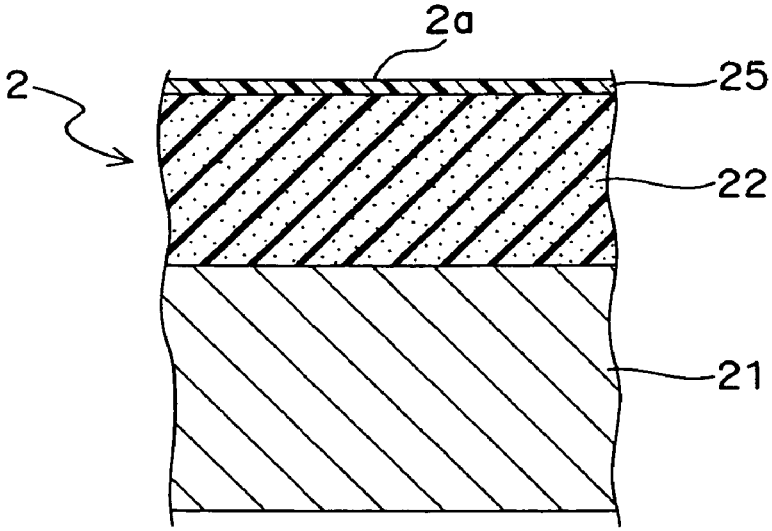
FIG. 3 is a view showing a cross sectional structure of a pressure roller in the fixing device.

As shown in FIG. 3, the pressure roller 2 has a three-layer structure formed from a shaft 21, a heat insulating layer 22 and a release layer 25, which are placed in sequence from the central side of the pressure roller 2 toward an outer peripheral surface 2*a* thereof, wherein the shaft 21 is made of aluminum having a thickness of 3 mm, the heat insulating layer 22 is made of silicon sponge rubber having a thickness of 3 mm to 10 mm, and the release layer 25 is made of fluorocarbon resin such as PTFE and PFA having a thickness of 10 to 50 μm.

The shaft 21 may be a steel pipe or a heat-resistant molded pipe made of, for example, PPS (polyphenylene sulfide) as long as the strength can be ensured. However, nonmagnetic material, which is less affected by electromagnetic induction heating, should be preferably used so as to prevent the shaft 21 from generating heat.

The thickness of the heat insulating layer 22, which is made of silicon sponge rubber, may appropriately be changed in the range of 3 mm to 10 mm in accordance with use conditions. The heat insulating layer 22 may have a two-layer structure composed of silicon rubber and silicon sponge.

The outermost release layer 25 is provided to enhance the releasing property of the outer peripheral surface 2*a*.

The pressure roller 2 is pressed against the fixing roller 1 shown in FIG. 1 with pressing force of 300 N to 500 N to form a nip section. In this case, the nip width is approx. 5 mm to 15 mm. The nip width may be changed by changing a load where necessary.

The magnetic flux generating section 3 has a coil bobbin 33, an exciting coil 31 and a magnetic core 32, as shown in FIG. 1. The coil bobbin 33 has a trapezoidal cross section and is placed to cover the upper section of the fixing roller 1. The exciting coil 31 is placed in layers along inclined surfaces of the coil bobbin 33. The magnetic core 32 has a trapezoidal cross section almost identical to the cross section of the coil bobbin 33 and is placed across the exciting coil 31 along the coil bobbin 33.

Figure 4:
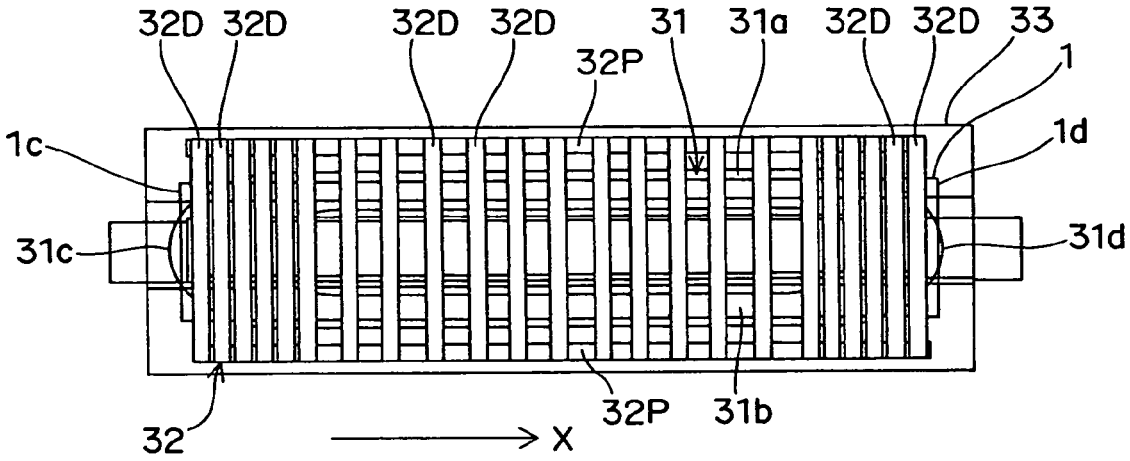
FIG. 4 is a view showing an upper side of the fixing device of FIG. 1.

As shown in FIG. 4, the coil bobbin 33, the exciting coil 31 and the magnetic core 32 are long members that have a length roughly corresponding to a longitudinal direction (axial direction) size X of the fixing roller 1.

The coil bobbin 33 is provided to support the exciting coil 31 and the magnetic core 32. The coil bobbin 33 should be preferably made of nonmagnetic materials. In this embodiment, the coil bobbin 33 is made of heat-resistant resin (e.g., polyimide) having a thickness of 1 mm to 3 mm.

The exciting coil 31 is provided to generate a magnetic flux upon reception of power supply from the HF inverter 4. The exciting coil 31 is formed by winding a bundle of conductive wires a plurality of times in an elongated oval shape. More strictly, the bundle of conductive wires has an outward section 31, a homeward section 31*b* and curved sections 31*c*, 31*d*. The outward section 31 and the homeward section 31*b* extend along the longitudinal direction X of the fixing roller 1. The curved sections 31*c*, 31*d* connect the outward section 31 and the homeward section 31*b* at both ends 1*c*, 1*d* of the fixing roller 1. One bundle of conductive wires is a known as a stranded wire having a diameter of about several mm which is formed by bunching about a hundred and several dozen wires (copper wires with a diameter of 0.18 mm to 0.20 mm coated with enamel for insulation) for enhancing conduction efficiency. Thereby, it becomes possible to receive 100 W to 2000 W electric power with drive frequencies of 10 kHz to 100 kHz from the HF inverter 4. In this embodiment, the coil coated with heat-resistant resin is used in consideration of the case that heat is transferred to the coil.

The magnetic core 32 is provided to increase the efficiency of magnetic circuits and to shield magnetism. In this embodiment, the magnetic core 32 includes a pair of end sections 32P, 32P extending in the longitudinal direction X and a plurality of trapezoidal sections 32D (having the cross section shown in FIG. 1) integrally formed over these end sections 32P, 32P. The trapezoidal sections 32D are arrayed at short intervals in the vicinity of both the ends of the end section in the longitudinal direction X thereof, while at long intervals in an inside portion of the end section other than the vicinity of both the ends. Magnetic material having high magnetic permeability and low loss is used as material of the magnetic core 32. In the case of using an alloy such as a permalloy, the magnetic core 32 may have a laminated structure because an eddy current loss in the core is increased by high frequencies. When there is a way to sufficiently provide magnetic shielding, the magnetic circuit section, which is generally comprised of the exciting coil 31 and the magnetic core 32, may be made coreless. Moreover, resin material containing dispersed magnet powders makes it possible to freely set its shape, although magnetic permeability becomes relatively low. Moreover, it is possible to enhance efficiency of heat generation by forming the magnetic core 32 into an E-shape in transverse section, so that a core protrudes toward the fixing roller 1 in the central section.

A magnetic flux generated by the exciting coil 31 passes through the inside of the magnetic core 32 without leaking to the outside. When the magnetic flux reaches a portion between protrusions of the core, the magnetic flux leaks to the outside of the magnetic core for the first time to penetrate the heat generating layer 13 of the fixing roller 1. This causes an eddy current to flow through the heat generating layer 13 and makes the heat generating layer 13 itself generate heat (Joule heat). The portion immediately below the heat generating layer 13 of the fixing roller 1 is insulated by the heat insulating layer 12 (see FIG. 2). Therefore, heat generated by the heat generating layer 13 swiftly heats the elastic layer 14 and the release layer 15. This rises temperature of the outer peripheral surface 1*a* of the fixing roller 1 (referred to as "fixing roller surface temperature).

Heating temperature of the fixing roller 1 is controlled by the control circuit 5. A temperature sensor 6 such as a thermister is placed to be in contact with the outer peripheral surface 1*a* of the fixing roller 1. A detection signal of a temperature sensor 6 represents the fixing roller surface temperature and is inputted into the control circuit 5. Based on the detection signal from the temperature sensor 6, the control circuit 5 controls the HF inverter 4 to increase or decrease power supply from the HF inverter 4 to the exciting coil 31. Thereby, surface temperature of the fixing roller is automatically controlled so that a specified constant temperature is maintained. This makes it possible to maintain the fixing roller surface temperature when heat is removed by a paper sheet 90.

At the time of fixing operation, the pressure roller 2 is rotationally driven. Following after this rotation, the fixing roller 1 rotates. At the same time, the heat generating layer 13 of the tape clamp 13 is heated by electromagnetic induction through a magnetic flux generated in the magnetic flux generating section 3, so that the surface temperature of the fixing roller 1 is automatically controlled to maintain a specified constant temperature. In this state, an unshown transportation mechanism sends the paper sheet 90, which is a sheet of paper with an unfixed toner image 91 formed on one side surface, into the nip section formed from the fixing roller 1 and the pressure roller 2. Then, the one side surface of the paper sheet 90, where the unfixed toner image 91 is formed, comes into contact with the fixing roller 1. The paper sheet 90 is sent into the nip section, which is formed from the fixing roller 1 and the pressure roller 2, so as to be heated by the fixing roller 1 while passing the nip section. As a result, the unfixed toner image 91 is fixed onto the paper sheet 90. The paper sheet 90 which has passed through the nip section is discharged and released from the fixing roller 1. Even if the paper sheet 90 should adhere to the outer peripheral surface 1*a* of the fixing roller after paper sheet 90 passes through the nip section, a separation nail 8, which is placed in contact with the outer peripheral surface 1*a* of the fixing roller, forcedly releases the paper sheet 90 from the outer peripheral surface 1*a* of the fixing roller so as to prevent a jam.

Figure 6:
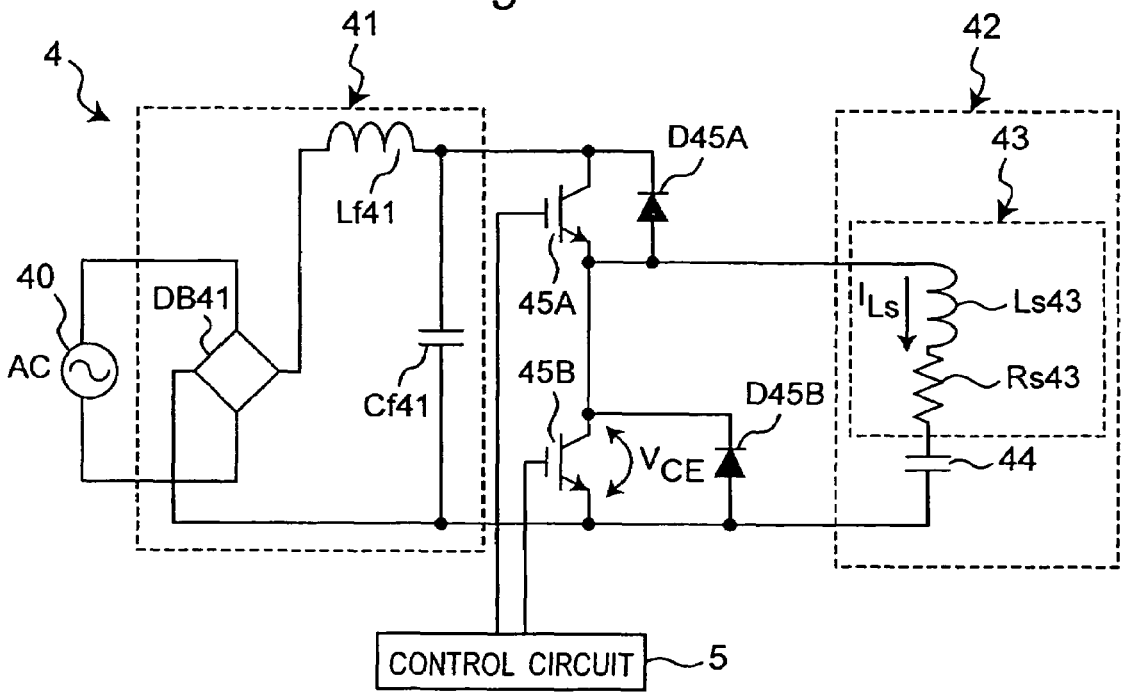
FIG. 6 is a view specifically showing a circuit structure of an HF inverter for supplying electric current to the IH unit in the fixing device.

FIG. 6 specifically shows a circuit structure of the HF inverter 4 which supplies power to an IH unit 43.

Figure 5:
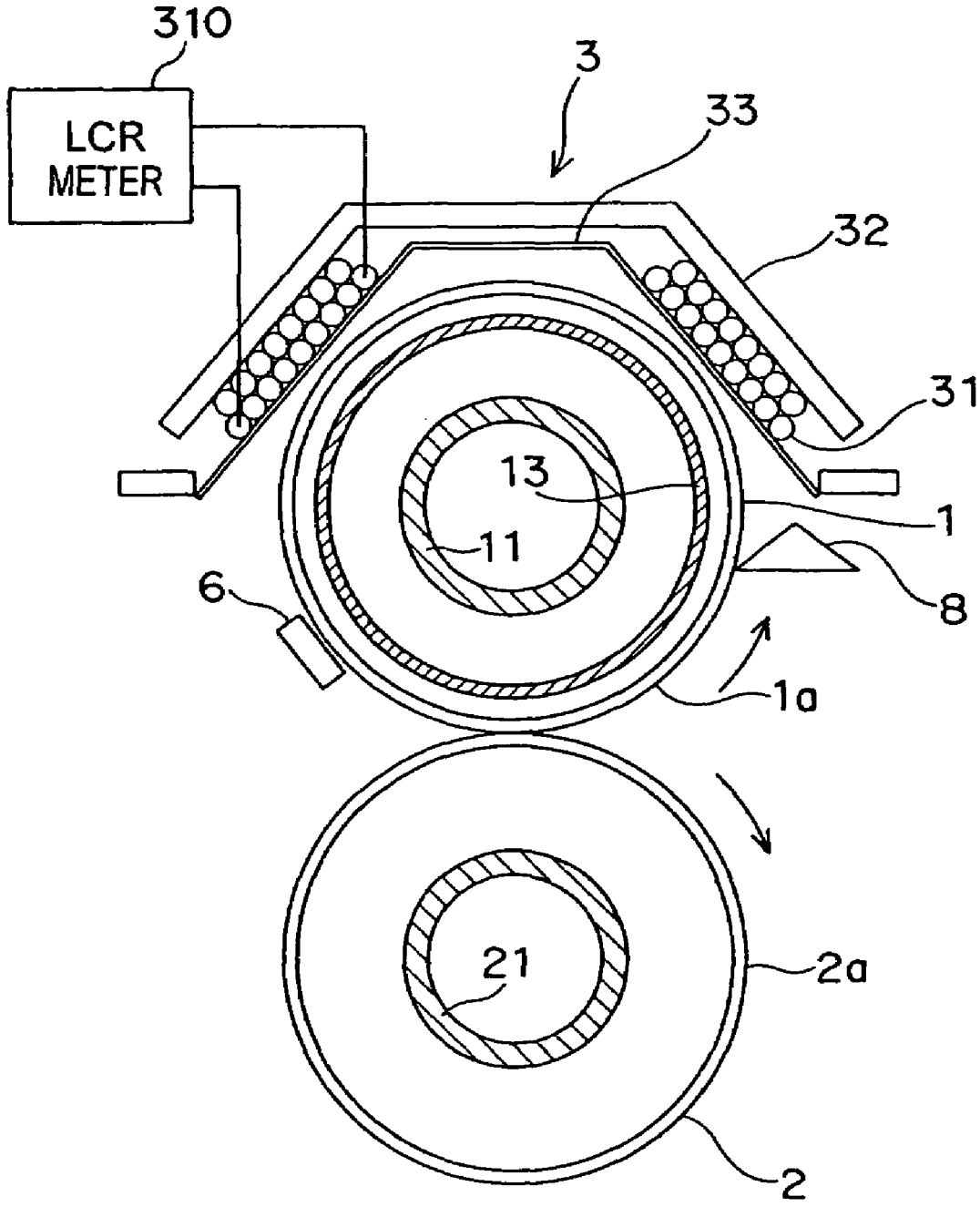
FIG. 5 is a view explaining how to measure an effective resistance value Rs of an IH unit in the fixing device.

The IH unit 43 is shown as a series equivalent circuit composed of an inductance Ls43 and an effective resistance Rs43 in FIG. 6. The series equivalent circuit includes not only contribution from the exciting coil 31 in the magnetic flux generating section 3 shown in FIG. 1, but also contribution from the fixing roller 1 and the core 32 coupled with the exciting coil 31 by electromagnetic induction. The values of the inductance Ls43 and the effective resistance Rs43 are measured by connecting an impedance measuring device 310, which is generally called an LCR meter, to both ends of the exciting coil 31 in the magnetic flux generating section 3, as shown in FIG. 5.

A series resonant circuit 42 is constructed by connecting a resonant capacitor 44 to the IH unit 43 or practically the exciting coil 31 in series. A resonance frequency $f_0$ (unit: Hz) of the series resonant circuit 42 is attained by Equation (2):

$$f_0=1/(2\Pi(LsC)^{1/2}) \quad (2)$$

in which Ls represents a value of the inductance Ls43 (unit: H (henry)), and C represents capacity of the resonant capacitor 44 (unit: F (farad)).

The HF inverter 4 includes an AC power source 40, a diode bridge DB41, a rectification circuit 41 composed of a smoothing coil Lf41 and a smoothing capacitor Cf41, a pair of switching elements 45A, 45B each made of power transistors, and flywheel diodes D45A, D45B for protecting these switching elements 45A, 45B from overvoltage.

A pair of the switching elements 45A, 45B are on/off controlled with a certain drive frequency f by the control circuit 5 serving as a control section. Thus, electric power is inputted into the IH unit 43, specifically into the magnetic flux generating section 3 as well as the fixing roller 1.

Figure 7:
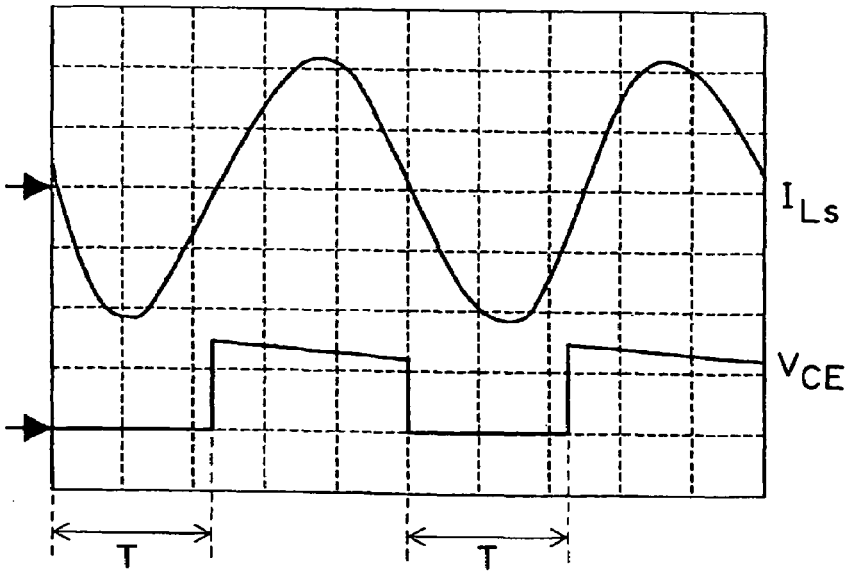
FIG. 7 is a view showing a drive waveform of a series resonant circuit in the fixing device.

FIG. 7 shows drive waveforms of the series resonant circuit 42. In FIG. 7, $I_{LS}$ denotes a current flowing through the IH unit 43, $V_{CE}$ denotes a collector-emitter voltage of the respective switching elements 45A, 45B, and T denotes a turn-on period of the switching elements.

When the drive frequency f and the resonance frequency $f_0$ are equal in the series resonant circuit 42, an impedance Z is minimized. Therefore, a current flow is maximized, which maximizes electric power inputted into the fixing roller 1 through the magnetic flux generating section 3 (this is called "maximum input power $Pw_{MAX}$" as appropriate). Thus, high electric power can be inputted even if the heat generating layer of the fixing roller 1 has a thickness as thin as 100 μm or less as in the case of this example and the drive frequency is thereby set high. In other words, high heat generation efficiency and high input power can be achieved at the same time. As a result, it becomes possible to warm up the device in a short period of time and to increase a paper passing speed.

The electric power inputted into the fixing roller 1 can be controlled by increasing the drive frequency f slightly from the resonance frequency $f_0$ to slightly decrease the current flowing to the series resonant circuit 42.

In the case of using the series resonant circuit 42, the maximum input power $Pw_{MAX}$ depends on an effective resistance Rs43 value (hereinbelow referred to as "Rs") of the IH unit 43. The effective resistance value Rs can variably be set by changing, for example, the structure and material of the magnetic flux generating section 3 (exciting coil 31 and the core 43) forming the IH unit. 43 and the fixing roller 1, and/or by changing the distance between the magnetic flux generating section 3 and the fixing roller 1.

Description is now given as to how to variably set the effective resistance value Rs.

Figure 8:
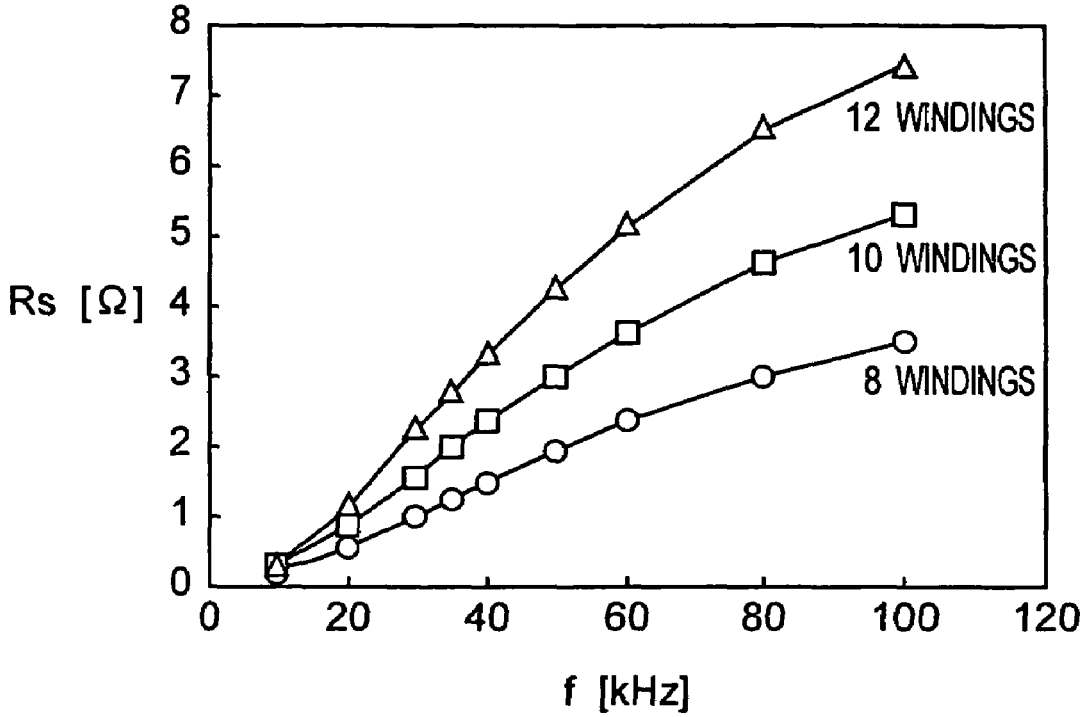
FIG. 8 is a view showing measurement results of the effective resistance value Rs with various drive frequencies f by using the number of windings of an exciting coil as a parameter.

In connection with the magnetic flux generating section 3, the effective resistance value Rs can be adjusted by decrease or increase in the number of windings of the exciting coil 31, as shown in FIG. 8, which is wound along the longitudinal direction of the fixing roller 1. Rs (inductance Ls as well) is decreased by decreasing the number of windings. Also, the effective resistance value Rs can be adjusted by decrease or increase in the number of strands (the number of bunched wires) in the bundle of conductive wires which constitutes the exciting coil 31. Rs (Ls as well) is decreased by increasing the number of strands.

In connection with placement of the core 32, the effective resistance value Rs can be adjusted by decrease or increase in interval between the trapezoidal sections 32D in the longitudinal direction X as shown in FIG. 4. Rs (Ls as well) is decreased by increasing the interval in the longitudinal direction X. Further, the effective resistance value Rs is also adjusted by the shape of the core 32.

In connection with the structure of the fixing roller 1, the effective resistance value Rs is mainly influenced by the heat generating layer 13 and/or the core shaft 11.

With regard to the heat generating layer 13, increase in thickness thereof brings disadvantages to paper sheet release and makes greater the thermal capacity of the heat generating layer itself, which may exercise an adverse influence upon the temperature rise characteristic. Decrease in the thickness causes the drive frequency f to be highly set due to influence of penetration depth, which may result in increase of Rs. (Rs and Ls depend on frequency, and Rs is increased by increase in frequency). Therefore, it is important for the heat generating layer 13 to balance these factors. This leaves little room for freely changing thickness of the heat generating layer 13 when variably setting Rs.

With regard to the core shaft 11, parameters such as an outer diameter, material and thickness thereof can be variously changed without any particular failure.

Figure 9A:
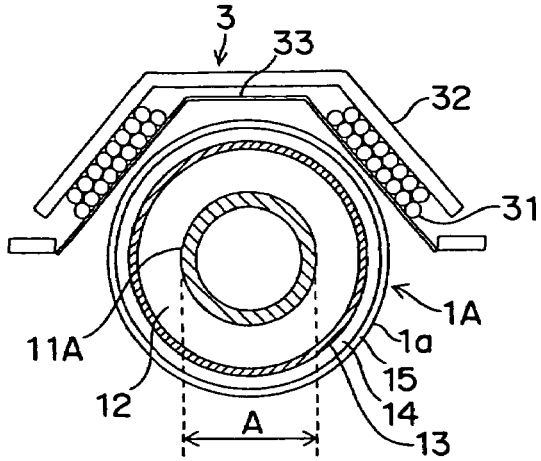
FIG. 9A is a view showing a setting example of an outer diameter of a fixing roller shaft.
Figure 9B:
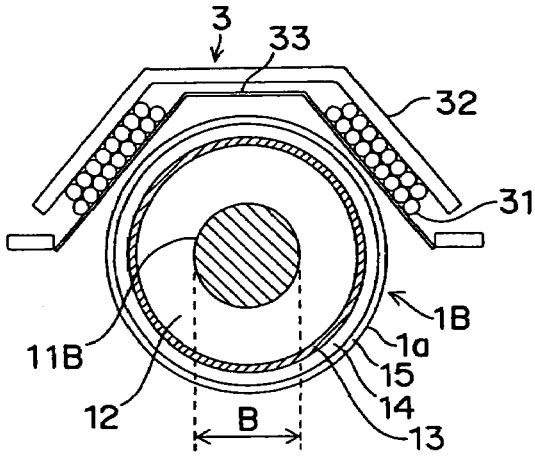
FIG. 9B is a view showing another setting example of the outer diameter of the fixing roller shaft.
Figure 9C:
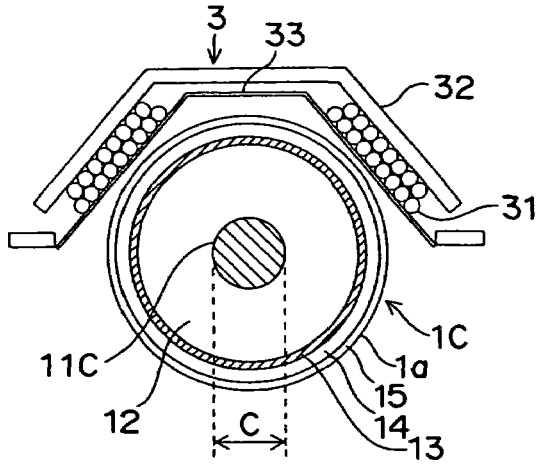
FIG. 9C is a view showing still another setting example of the outer diameter of the fixing roller shaft.

The outer diameter of the core shaft 11 can be changed to for example A, B or C of shafts 11A, 11B or 11C as shown in FIGS. 9A, 9B and 9C. The ratios of outer diameters A, B and C to the outer diameter (40 mm for this example) of the fixing roller 1 are 70%, 60% and 50%, respectively.

The material of the core shaft 11 may be changed to Al (volume resistivity: $2.75\times10^{-8}\Omega\cdot m$), Fe alloy (volume resistivity: $20\times10^{-8}\Omega\cdot m\sim40\times10^{-8}\Omega\cdot m$) or nonmagnetic stainless steel (volume resistivity: $70\times10^{-8}\Omega\cdot m$).

The core shaft 11 may be changed to be hollow with a thickness of e.g. 4 mm or to be solid.

Figure 10:
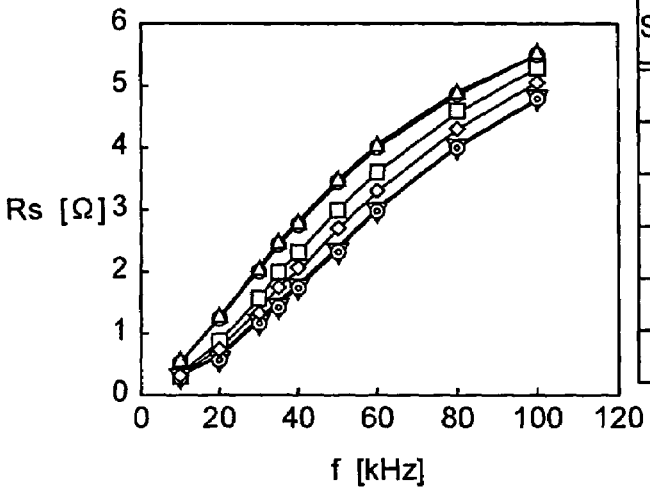
FIG. 10 is a view showing measurement results of the effective resistance value Rs with various drive frequencies f by using the outer diameter, material and thickness or the like of the shaft as a parameter.

FIG. 10 shows measurement results of the effective resistance value Rs when changing the parameters such as the outer diameter, material, thickness etc. of the core shaft 11.

As is clear from FIG. 10, the values of Rs (Ls as well) are decreased as the outer diameters of the core shaft 11 become larger when the fixing rollers have same diameter and are made of same material.

Even when the shapes of the core shaft 11 are identical to each other, the value of Rs in a material having a lower volume resistivity such as Fe alloy (volume resistivity $20\times10^{-8}\ \Omega\cdot m\sim40\times10^{-8}\ \Omega\cdot m$) or the nonmagnetic SUS (volume resistivity $70\times10^{-8}\ \Omega\cdot m$) is lower than that in a material having a higher volume resistivity such as Al (volume resistivity $2.75\times10^{-8}\ \Omega\cdot m$) In this case, Ls is not much different. It is to be noted that Fe is a ferromagnetic material which possibly generates heat by receiving a magnetic flux, and therefore deteriorates the heat generation efficiency of the heat generating layer 13.

The values of Rs or Ls almost equal regardless of the thickness of the core shaft 11 when the hollow core shaft 11 has a thickness of 2 mm or more or when the core shaft 11 is solid (or equivalent to the maximum of thickness). In the case where the hollow core shaft 11 has less than 2 mm in thickness, Rs is decreased as the thickness becomes greater.

As for the distance between the magnetic flux generating section 3 and the fixing roller 1, Rs is decreased (instead, Ls is increased) as the distance becomes longer.

Figure 11:
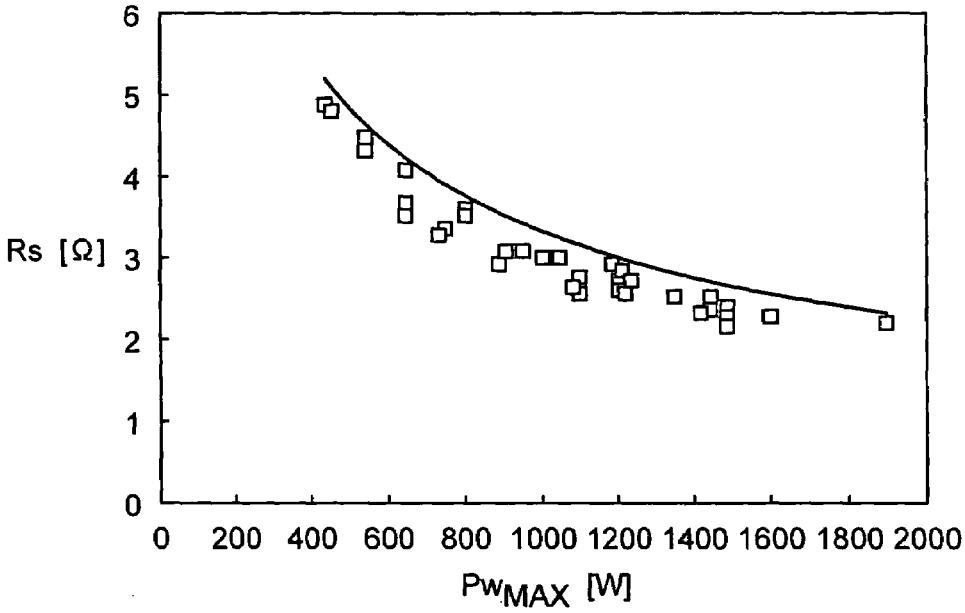
FIG. 11 is a scatter diagram showing relation between the effective resistance value Rs and a maximum input power $Pw_{max}$ on each of samples attained by setting parameters regarding a magnetic flux generating section and the fixing roller in the fixing device at various values.
Figure 12:
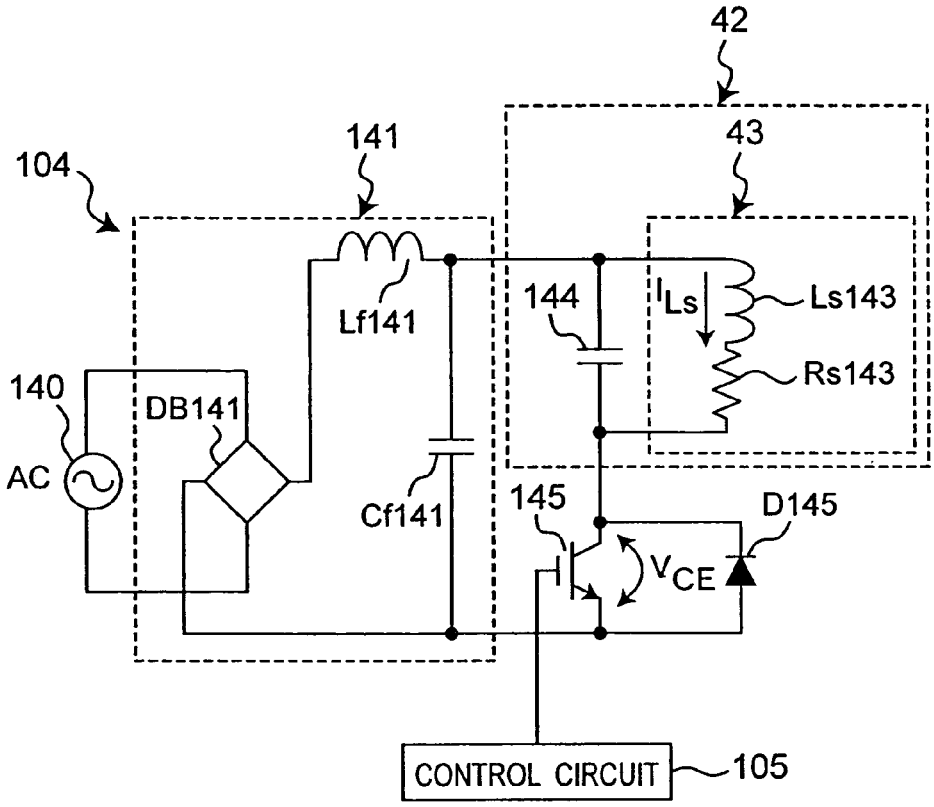
Fig.12 PRIOR ART
FIG. 12 is a view showing a structure of an HF power supply circuit including a parallel resonant circuit in a conventional fixing device.
Figure 13:
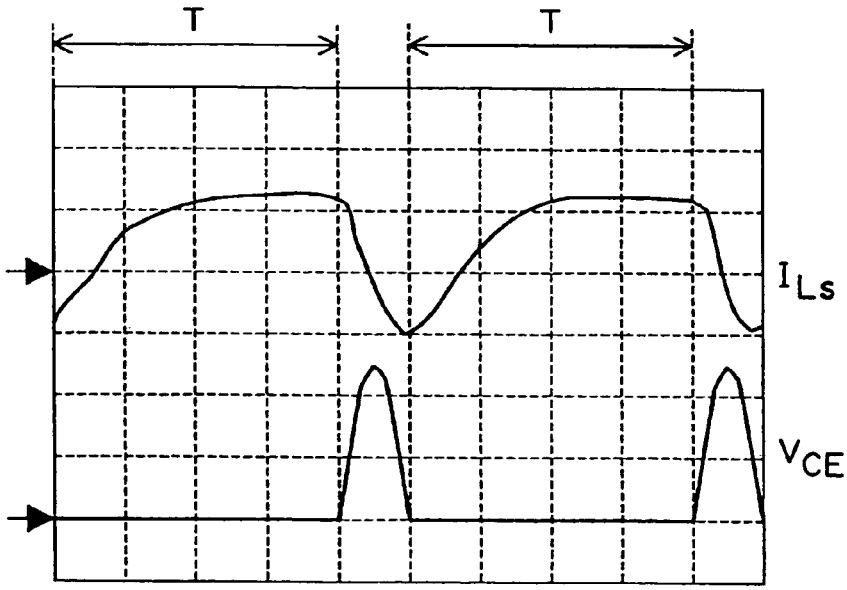
Fig.13 PRIOR ART
FIG. 13 is a view showing drive waveforms of the parallel resonant circuit in the conventional fixing device.

FIG. 11 is a scatter diagram showing relation between the effective resistance value Rs and the maximum input power $Pw_{max}$, wherein samples are respectively attained by setting parameters of the magnetic flux generating section 3 and the fixing roller 1 at various values, as stated above.

The inventors found out the following relation from FIG. 11.

$$Rs<147.88\times Pw_{MAX}^{-0.5498} \tag{3}$$

This equation indicates that it becomes possible to attain a desired maximum input power $Pw_{max}$ when an effective resistance value Rs (unit: ohms) is selected to satisfy the relation in Equation (3) after the desired maximum input power $Pw_{max}$ (unit: watts) is defined. For example, Rs may be set at 3Ω or less when the desired maximum input power $Pw_{max}$ is 1200 W.

Combination of the above-mentioned parameters can lead to a lower setting of the effective resistance value Rs in such a way as to satisfy the relation in Equation (3).

For example when the volume resistivity of the material of the core shaft 11 is $3\times10^{-8}\ \Omega\cdot m$ or less, it becomes possible to make Rs relatively small. Also, when the thickness of the core shaft 11 is 2 mm or more, it becomes possible to make Rs relatively small. Further, when the core shaft 11 is made of a nonmagnetic material, it becomes possible to make Rs relatively small.

Furthermore, in order to enhance the fixing property, the releasing property or the like, setting a greater thickness in the heat insulating layer 12 of the fixing roller 1 may lead to setting a smaller outer diameter of the core shaft 11. When this setting allows the effective resistance value Rs to be increased, it is possible to adjust Rs so that Rs is totally decreased, for example, by reducing the winding number of the exciting coil 31 and/or by increasing the distance between the magnetic flux generating section 3 and the fixing roller 1.

The same is true in the case where, for example, the effective resistance value Rs is increased by changing material of the core shaft 11 to that having a high volume resistivity such as Fe (iron or steel) or stainless steel in consideration of bending of the fixing roller 1. It is possible to adjust Rs so that Rs is totally decreased, for example, by reducing the winding number of the exciting coil 31 and/or by increasing the distance between the magnetic flux generating section 3 and the fixing roller 1.

It should be noted that the inductance Ls is also influenced as described above. It is necessary to pay attention to the value of Ls. When Ls decreases, magnetic flux density decreases. Thereby, the heat generation efficiency may be decreased. Therefore, it is necessary to make a balance between the input power and the heat generation efficiency attributed to Ls.

Although description has been given of the fixing device for a color printer in this embodiment, the present invention is not limited thereto. The present invention is widely applicable to various electromagnetic induction-type fixing devices.

The invention being thus described, it will be obvious that the invention may be varied in many ways. Such variations are not be regarded as a departure from the spirit and scope of the invention, and all such modifications as would be obvious to one skilled in the art are intended to be included within the scope of the following claims.

The invention claimed is:

1. A fixing device comprising:

a magnetic flux generating section having a coil for generating a magnetic flux when applying current;

a fixing roller having a heat generating layer having a thickness of 100 μm or less formed along an outer peripheral surface of the fixing roller for generating heat through electromagnetic induction by the magnetic flux;

a capacitor connected in series to the coil to constitute a series resonant circuit; and a high frequency power supply circuit for applying voltage having a certain drive frequency to the series resonant circuit so as to make the fixing roller generate heat through the magnetic flux generating section, wherein an image is fixed onto a sheet of paper, which is transported in a state of being in pressure-contact with the outer peripheral surface of the fixing roller, by heat from the heat generating layer of the fixing roller.

2. The fixing device as set forth in claim 1, wherein when the drive frequency is equal to a resonance frequency of the series resonant circuit, following relation is satisfied:

$$Rs \leqq 147.88 \times \times Pw_{MAX}^{-0.5498}$$

where $Pw_{MAX}$ represents electric power in watts, the electric power being inputted into the magnetic flux generating section and the fixing roller by the high frequency power supply circuit, and Rs represents an effective resistance value in ohms, the effective resistance value being measured between both end sections of the coil.

3. The fixing device as set forth in claim 1, wherein a support layer supporting the heat generating layer of the fixing roller has a volume resistivity of $3\times10^{-8}$ Ω·m or less.

4. The fixing device as set forth in claim 1, wherein the support layer supporting the heat generating layer of the fixing roller has a thickness of 2 mm or more.

5. The fixing device as set forth in claim 1, wherein the support layer supporting the heat generating layer of the fixing roller is made of aluminum.

6. The fixing device as set forth in claim 1, wherein the support layer supporting the heat generating layer of the fixing roller is made of nonmagnetic material.

7. A fixing device for fixing toner on a sheet, comprising:

a fixing roller having a heat insulating layer, a heat generating layer, an elastic layer and a release layer formed in sequence around a support layer, the heating layer having a thickness of 100 μm or less;

a pressure roller placed in pressure-contact with the fixing roller;

a magnetic flux generating section having a coil placed in such a way as to face an outer periphery of the fixing roller and generating a magnetic flux when applying current;

a capacitor connected in series to the coil to constitute a series resonant circuit; and a high frequency power supply circuit for applying voltage having a certain drive frequency to the series resonant circuit so as to make the fixing roller generate heat through the magnetic flux generating section.

8. The fixing device as set forth in claim 7, wherein when the drive frequency is equal to a resonance frequency of the series resonant circuit, following relation is satisfied:

$$Rs \leqq 147.88 \times Pw_{MAX}^{-0.5498}$$

where $Pw_{MAX}$ represents electric power in watts, the electric power being inputted into the magnetic flux generating section and the fixing roller by the high frequency power supply circuit, and Rs represents an effective resistance value in ohms, the effective resistance value being measured between both end sections of the coil.

9. The fixing device as set forth in claim 7, wherein a support layer supporting the heat generating layer of the fixing roller has a volume resistivity of $3\times10^{-8}$Ω·m or less.

10. The fixing device as set forth in claim 7, wherein the support layer supporting the heat generating layer of the fixing roller has a thickness of 2 mm or more.

11. The fixing device as set forth in claim 7, wherein the support layer supporting the heat generating layer of the fixing roller is made of aluminum.

12. The fixing device as set forth in claim 7, wherein the support layer supporting the heat generating layer of the fixing roller is made of nonmagnetic material.

* * * * *